US006494239B1

(12) United States Patent
Liao

(10) Patent No.: US 6,494,239 B1
(45) Date of Patent: Dec. 17, 2002

(54) WOOD PLANING MACHINE WITH A HEIGHT ADJUSTING UNIT

(76) Inventor: Juei-Seng Liao, No. 295, Sec. 1, Nanking E. Rd., Taichung CIty (TW)

( * ) Notice: Subject to any disclaimer, the term of this patent is extended or adjusted under 35 U.S.C. 154(b) by 0 days.

(21) Appl. No.: 10/103,007

(22) Filed: Mar. 21, 2002

(30) Foreign Application Priority Data

Dec. 31, 2001 (TW) ..... 090224279 U

(51) Int. Cl.[7] ..... B27C 1/00

(52) U.S. Cl. ..... 144/129; 144/114.1; 144/117.1; 248/188.2

(58) Field of Search ..... 144/114.1, 116, 144/117.1, 129, 130; 248/188.2; 409/228, 232, 234, 241, 210, 218

(56) References Cited

U.S. PATENT DOCUMENTS 2,960,125 A * 11/1960 Erickson et al. ..... 144/129
5,143,128 A * 9/1992 Chen ..... 144/129
5,979,521 A * 11/1999 Garcia ..... 144/129
6,390,425 B1 * 5/2002 Juang ..... 248/188.2

* cited by examiner

*Primary Examiner*—W. Donald Bray
(74) *Attorney, Agent, or Firm*—Trop, Pruner & Hu, P.C.

(57) ABSTRACT

A wood planing machine includes a main support, a work table movably seated on the main support, and a height adjusting unit. The main support has an inclined mounting wall extending inclinedly relative to the work table. A sliding member is slidably mounted on the mounting wall. A threaded part is mounted on the sliding member. A screw rod is mounted on the mounting wall and threadedly engages the threaded part for moving the threaded part together with the sliding member and the work table on the mounting wall upon rotation so as to adjust the height of the work table relative to the main support.

4 Claims, 7 Drawing Sheets

WOOD PLANING MACHINE WITH A HEIGHT ADJUSTING UNIT

CROSS-REFERENCE TO RELATED APPLICATION

This application claims priority of Taiwan patent Application No. 90224279, filed on Dec. 31, 2001.

BACKGROUND OF THE INVENTION

1. Field of the Invention

This invention relates to a wood planing machine, more particularly to a wood planing machine with a height adjusting unit for adjusting the height of a work table of the wood planing machine.

2. Description of the Related Art

FIGS. 1 and 2 illustrate a conventional wood planing machine for planing a wooden work-piece (not shown). The planing machine includes a main support 11 defining a mounting wall 123 that faces upwardly and inclinedly relative to a horizontal plane, and a work table 10 having a horizontal plate 12 that defines the horizontal plane, and front and rear side plates 122 that project downwardly from the horizontal plate 12 and that are mounted slidably on the mounting wall 123 so as to permit the work table 10 to be movable in a longitudinal direction, which, in turn, permits adjustment of the thickness of the wooden work-piece to be planed. A height adjustment unit is mounted on the main support 11, and includes a threaded part 131 that is secured to a bottom of the horizontal plate 12, and a handle wheel 134 with a screw rod 133 that is secured to the main support 11 and that threadedly engages the threaded part 131 so as to permit sliding movement of the work table 10 together with the threaded part 131 in the longitudinal direction. The conventional planing machine is disadvantageous in that the thread formed in the threaded part 131 tends to be worn or damaged by the screw rod 133 due to vibration of the planing machine during that planing operation. Moreover, the side plates 122 of the work table 10 are mounted on the mounting wall 123 via a wedging mechanism which is difficult to be formed on the side plates 122 and the mounting wall 123.

SUMMARY OF THE INVENTION

Therefore, it is an object of the present invention to provide a wood planing machine that is capable of overcoming the aforesaid drawbacks associated with the prior art.

Accordingly, a wood planing machine of this invention comprises: a main support including a base that has opposite front and rear ends and opposite left and right ends, and front and rear side walls that respectively and uprightly project from the front and rear ends of the base, that cooperately confine a mounting space therebetween, and that define a top open end of the main support opposite to the base; a mounting seat disposed in the mounting space and extending between and secured to the front and rear side walls, the mounting seat having an inclined mounting wall that extends inclinedly relative to a horizontal plane in a longitudinal direction from the right end of the base toward the left end of the base and that is formed with an elongated slot which extends in the longitudinal direction; a sliding member that is slidably mounted on the inclined mounting wall within the mounting space, and that has a top wall extending in a horizontal direction parallel to the horizontal plane, the sliding member being slidable on the inclined mounting wall in the longitudinal direction; a work table defining the horizontal plane, covering the top open end of the main support, and secured to the top wall of the sliding member so as to be co-slidable with the sliding member in the longitudinal direction; and a height adjusting unit including a screw unit, and a threaded part mounted securely on the sliding member via the screw unit which extends through the elongated slot, the sliding member and the threaded part so as to permit concurrent sliding movement of the sliding member and the threaded part on the inclined mounting wall in the longitudinal direction. The height adjusting unit further includes a screw rod that is rotatably mounted on the mounting seat, that extends in the longitudinal direction, and that threadedly engages the threaded part so as to move the work table together with the sliding member and the threaded part in the longitudinal direction upon rotation.

BRIEF DESCRIPTION OF THE DRAWINGS

In drawings which illustrate an embodiment of the invention.

DETAILED DESCRIPTION OF THE PREFERRED EMBODIMENT

Figure 1:
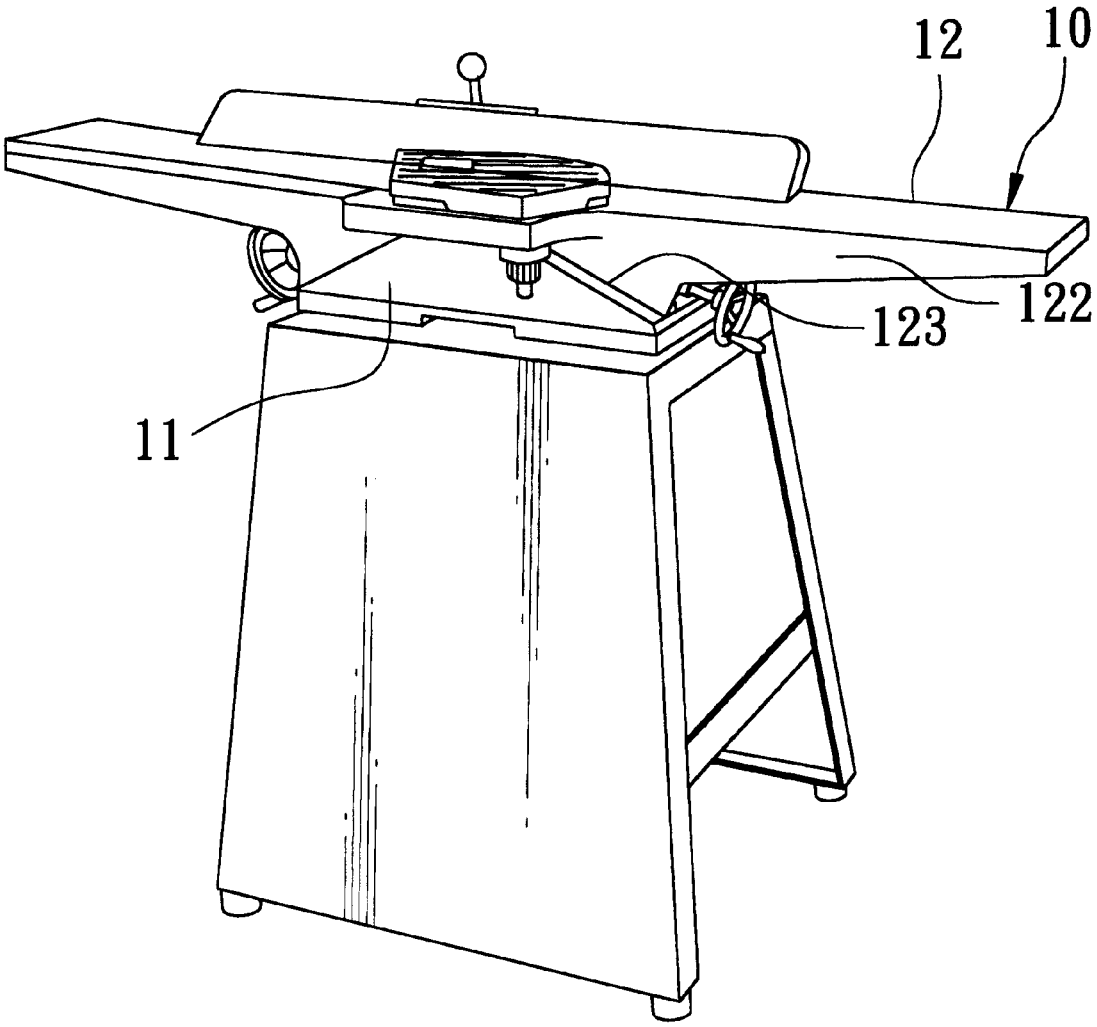
FIG. 1 PRIOR ART
FIG. 1 is a perspective view of a conventional wood planing machine.
Figure 2:
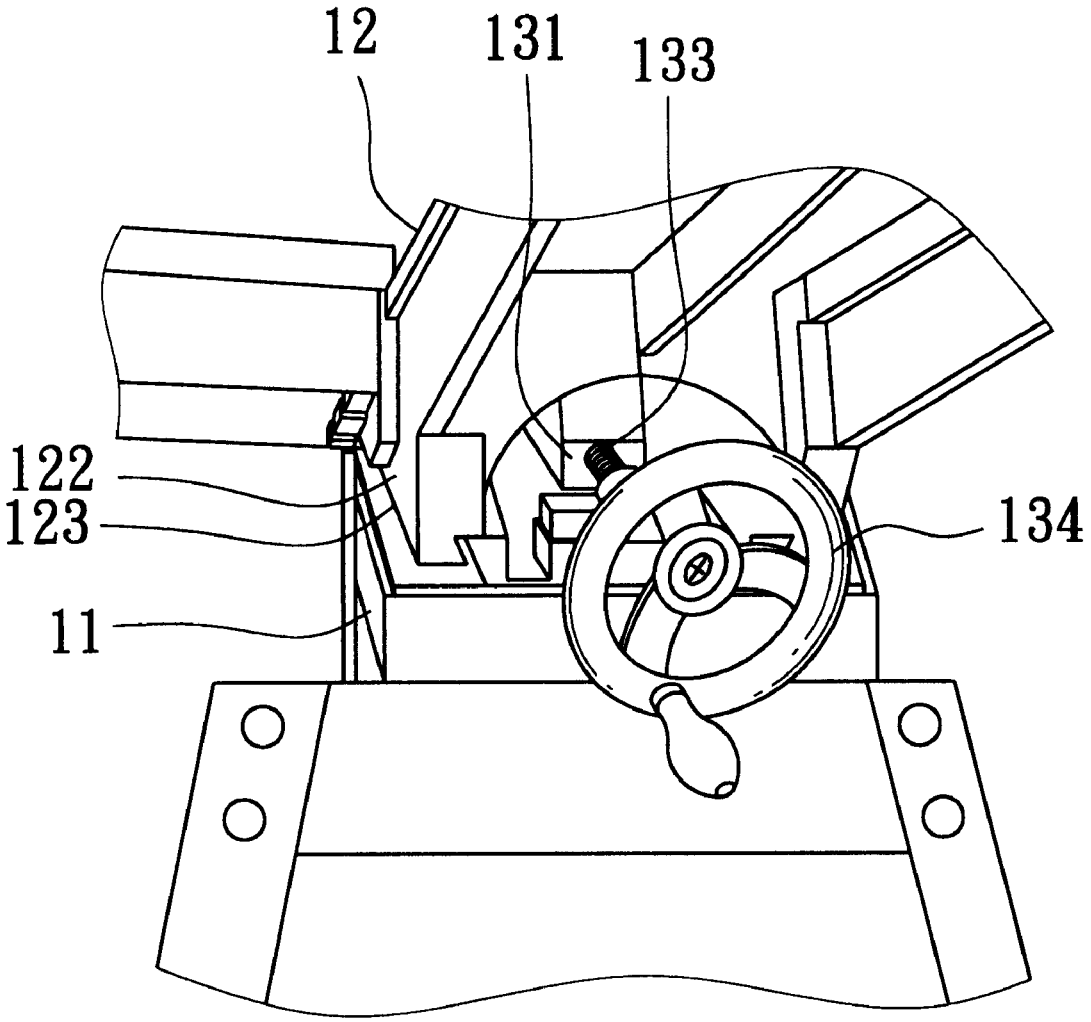
FIG. 2 PRIOR ART
FIG. 2 is a fragmentary perspective view of the wood planing machine of FIG. 1.
Figure 3:
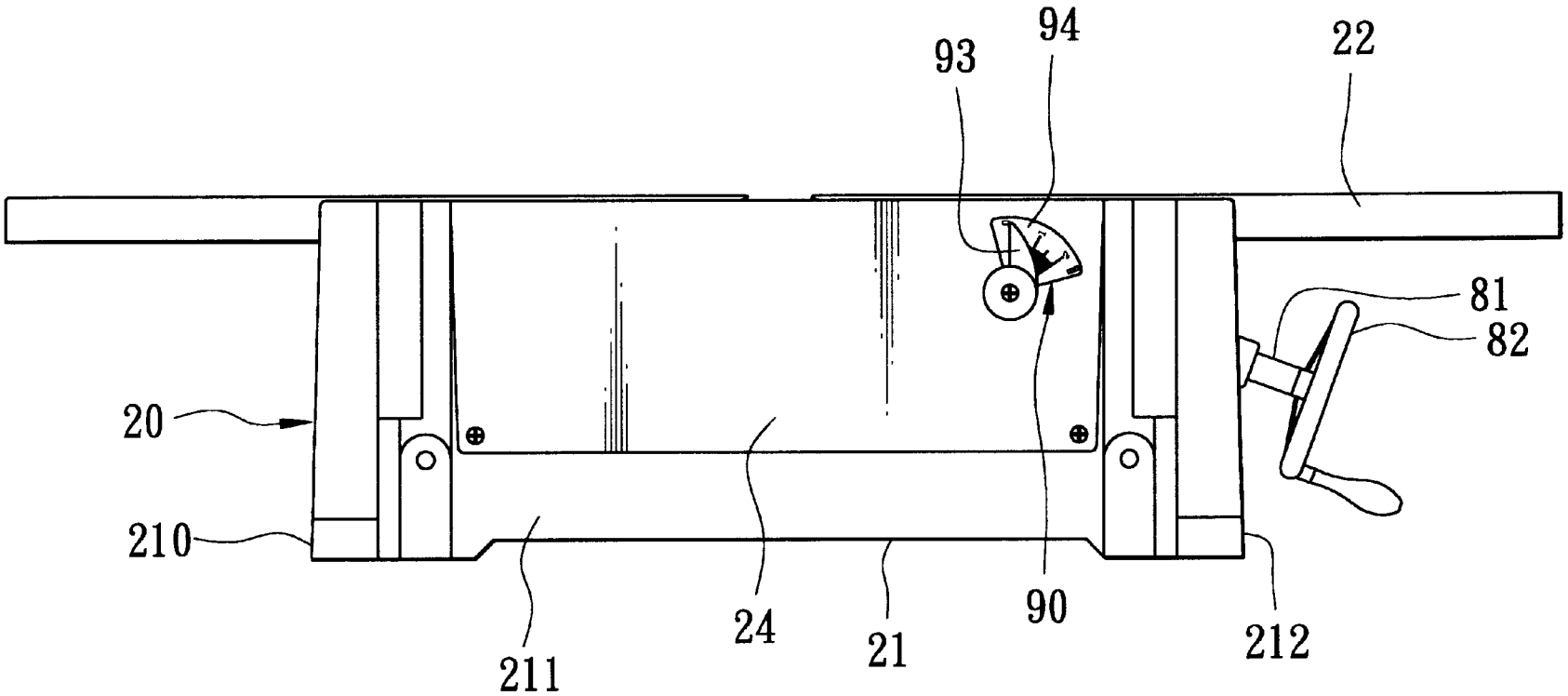
FIG. 3 is a front view of a wood planing machine embodying this invention.
Figure 4:
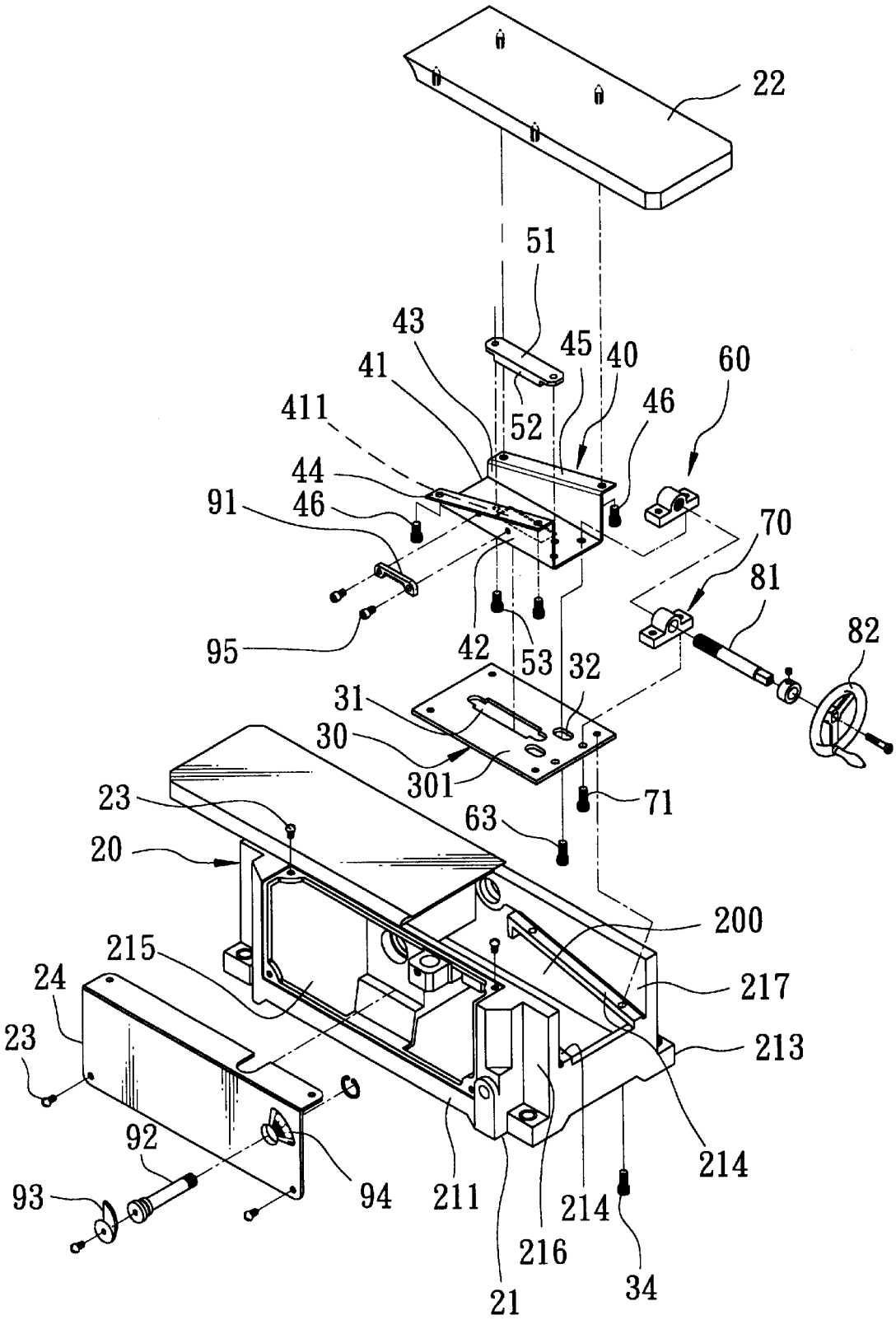
FIG. 4 is an exploded perspective view of the wood planing machine of FIG. 3.
Figure 5:
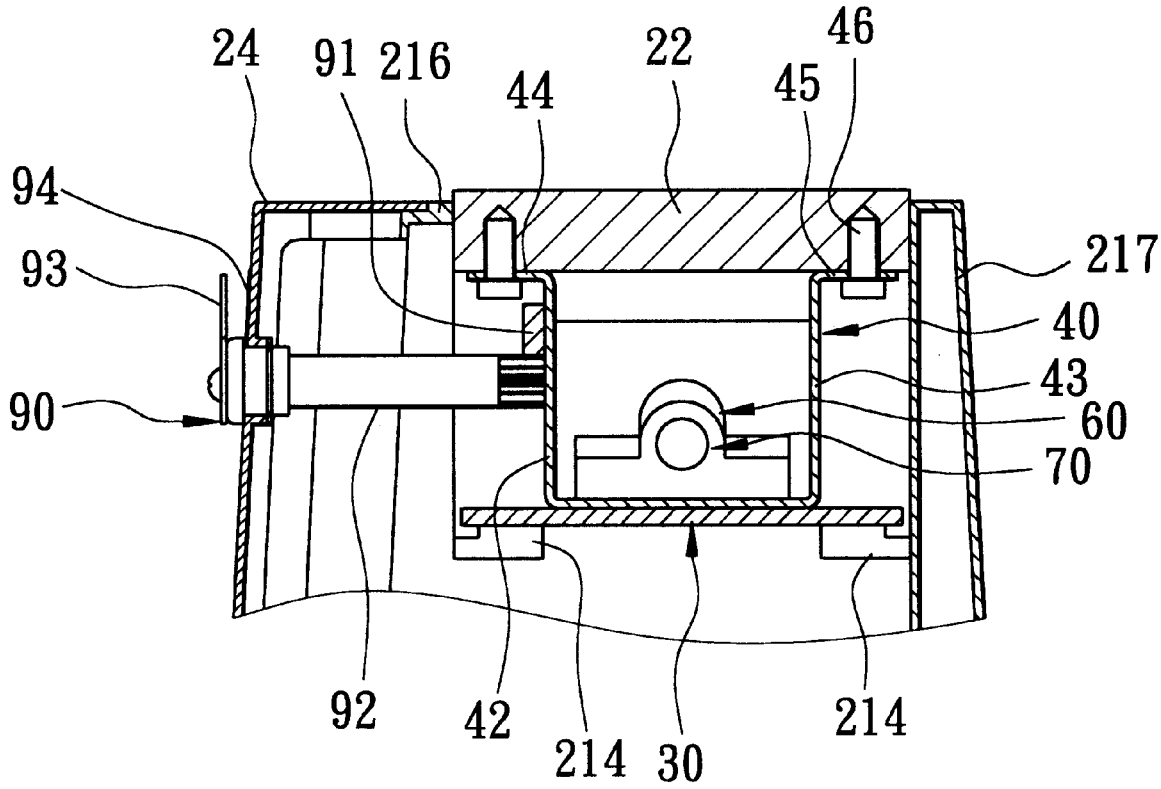
FIG. 5 is a fragmentary partly sectional view of the wood planing machine of FIG. 3.

FIGS. 3 to 6 illustrate a wood planing machine embodying this invention for planing a wooden work-piece (not shown). The wood planing machine includes: a main support 20 having a base 21 that has opposite front and rear ends 211, 213 and opposite left and right ends 210, 212, and front and rear side walls 216, 217 that respectively and uprightly project from the front and rear ends 211, 213 of the base 21, that cooperately confine a mounting space 200 therebetween, and that define a top open end of the main support 20 opposite to the base 21; a mounting seat (214, 30) disposed in the mounting space 200 and extending between and secured to the front and rear side walls 216, 217, the mounting seat (214, 30) having an inclined mounting wall 301 that extends inclinedly relative to a horizontal plane in a longitudinal direction from the right end 212 of the base 21 toward the left end 210 of the base 21 and that is formed with two parallel elongated slots 32 which extend in the longitudinal direction; a sliding member 40 that is slidably mounted on the inclined mounting wall 301 within the mounting space 200, and that has a top wall (44, 45) extending in a horizontal direction parallel to the horizontal plane, the sliding member 40 being slidable on the inclined mounting wall 301 in the longitudinal direction; a work table 22 defining the horizontal plane, covering the top open end of the main support 20, and secured to the top wall (44, 45)

of the sliding member 40 via screw means 46 so as to be co-slidable with the sliding member 40 in the longitudinal direction; and a height adjusting unit including screw means 63, and a threaded part 60 mounted securely on the sliding member 40 via the screw means 63 which extends through the elongated slots 32, the sliding member 40 and the threaded part 60 so as to permit concurrent sliding movement of the sliding member 40 and the threaded part 60 on the inclined mounting wall 301 in the longitudinal direction. The height adjusting unit further includes a screw rod 81 that is rotatably mounted on the mounting wall 301 of the mounting seat (214, 30), that extends in the longitudinal direction, and that threadedly engages the threaded part 60 so as to move the work table 22 together with the sliding member 40 and the threaded part 60 in the longitudinal direction upon rotation.

The mounting seat (214, 30) includes a pair of front and rear mounting rails 214 that respectively project from the front and rear side walls 216, 217 into the mounting space 200 and that extend in the longitudinal direction, and a mounting plate 30 that has front and rear ends respectively secured to the front and rear mounting rails 214 via screw means 34, and that defines the inclined mounting wall 301. The elongated slots 32 are formed in the mounting plate 30. A bearing seat 70 is secured to the mounting plate 30 via screw means 71, and includes a bearing ring for extension of the screw rod 81 therethrough and for permitting movement of the sliding member 40 in the longitudinal direction via the threaded part 60. A handle wheel 82 is connected to the screw rod 81 for turning the screw rod 81.

The sliding member 40 includes a bottom plate 41 extending in the longitudinal direction, slidably mounted on the mounting plate 30 via the screw unit 63, and having front and rear ends. The sliding member 40 further includes front and rear plates 42, 43 of equal dimension that have top ends, and that respectively and uprightly project from the front and rear ends of the bottom plate 41 in such a manner that the top ends of the front and rear plates 42, 43 extend in a direction parallel to the horizontal plane. The sliding member 40 further includes front and rear wings 44, 45 that respectively project from the top ends of the front and rear plates 42, 43 and that cooperately define the top wall (44, 45) of the sliding member 40.

The mounting plate 30 is further formed with a guiding slot 31 that extends in the longitudinal direction. The bottom plate 41 of the sliding member 40 is formed with an elongated aperture 411 that is vertically aligned with the guiding slot 31. The sliding member 40 further includes a guide 51 that is mounted securely on the bottom plate 41 via screw means 53 and that has a stud 52 projecting downwardly therefrom through the elongated aperture 411 and into the guiding slot 31 for guiding movement of the sliding member 40 on the mounting plate 30 in the longitudinal direction.

The front side wall 216 is formed with an access opening 215. A cover 24 is secured to a periphery of the access opening 215 via screw means 23 for covering the access opening 215. A height indicator 90 is mounted on the cover 24, and is associated with the sliding movement 40 via a rack-and-pinion unit (92, 91) for indication of the height of the worktable 22 relative to the main support 20. The rack-and-pinion unit (92, 91) includes a rack 91 mounted on the front plate 42 of the sliding member 40 via screw means 95, and a pinion 92 engaging the rack 91 and extending outwardly of the mounting space 200 through the cover 24. The height indicator 90 includes a scale 94 attached to the cover 24, and a pointer 93 connected to the pinion 92 and pointing to the scale 94 for indication of the height of the work table 22.

Figure 6:
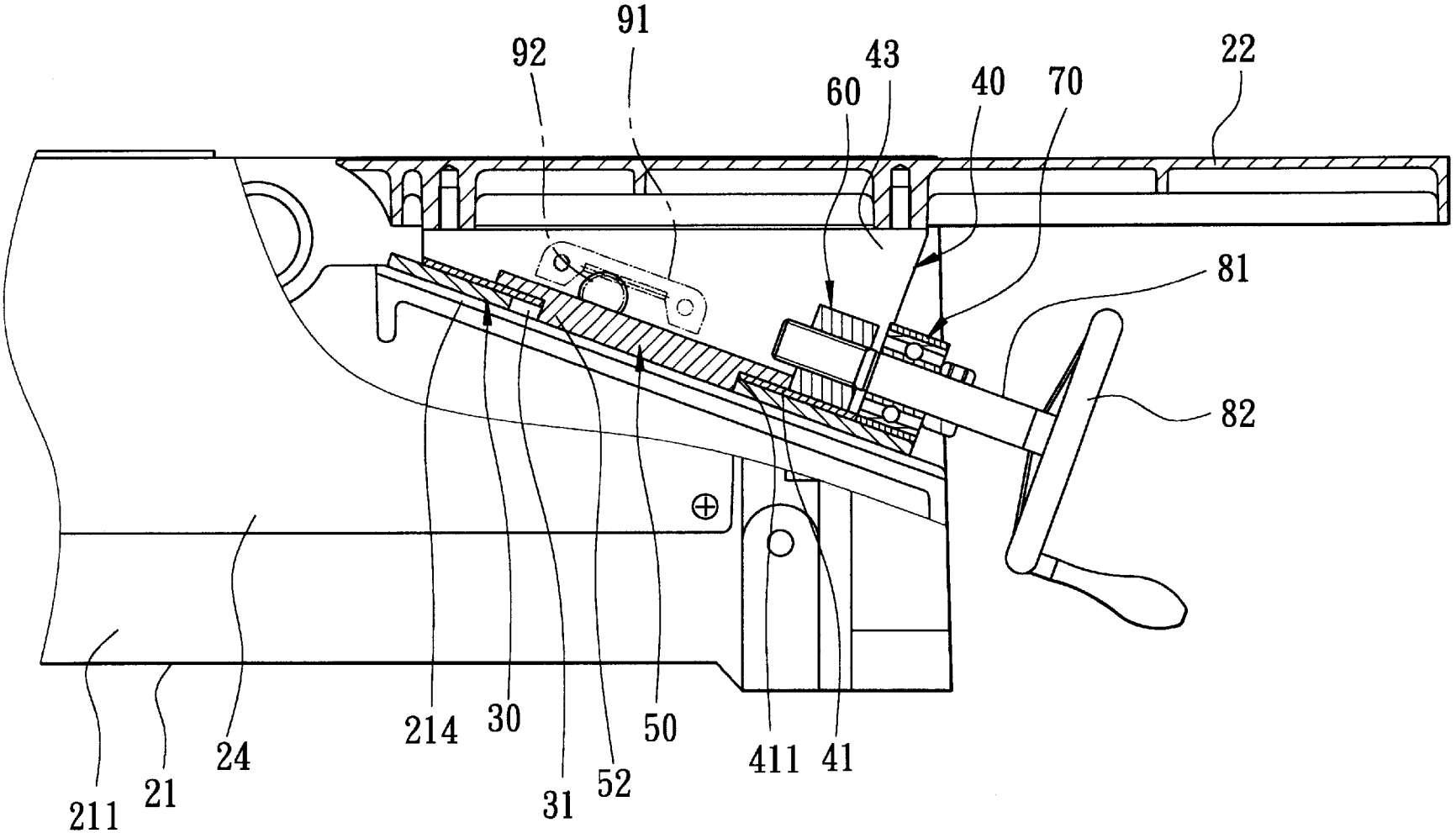
FIG. 6 is a partly sectional front view to illustrate how a work table of the wood planing machine of FIG. 3 is adjusted by a height adjustment unit to a lower position.
Figure 7:
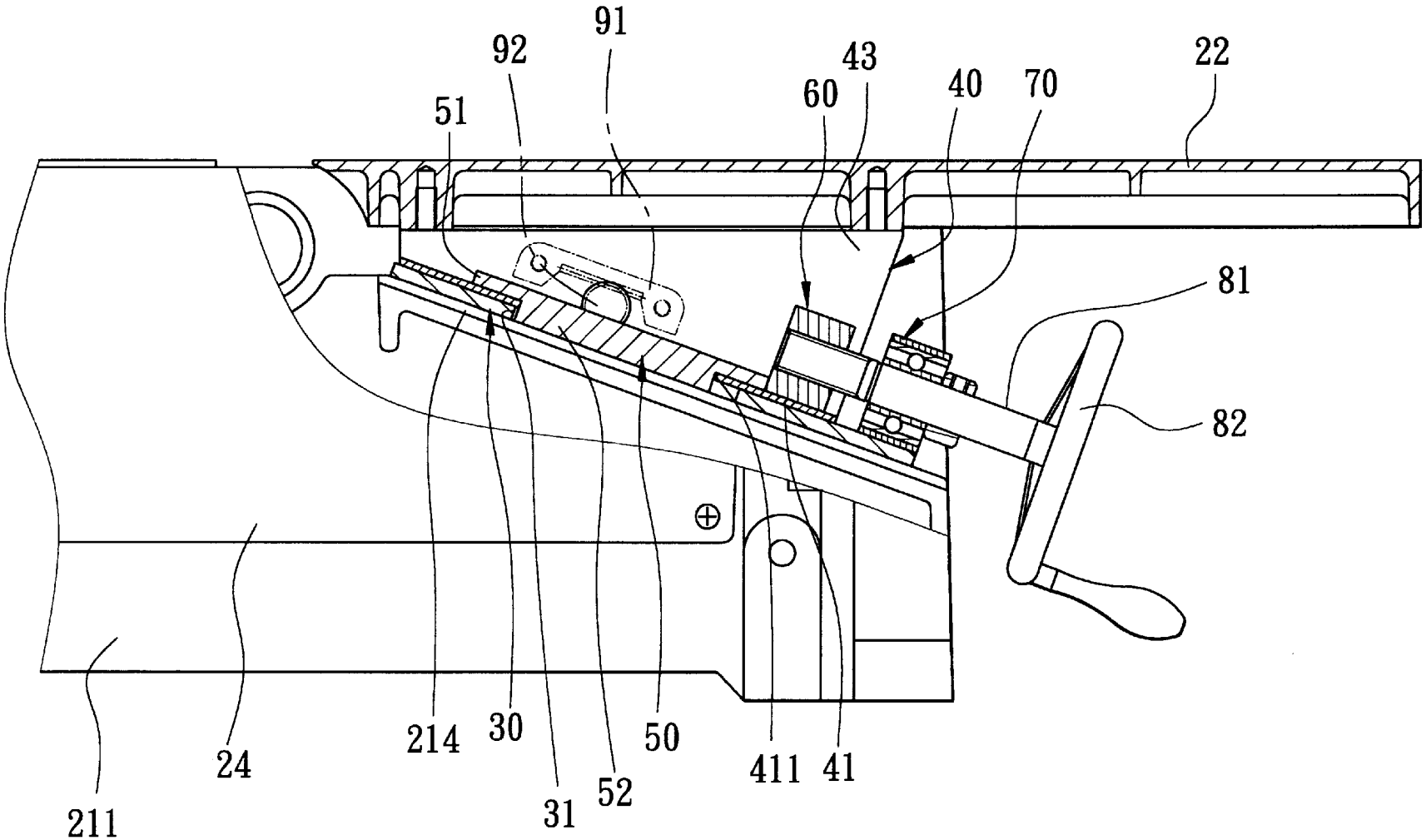
FIG. 7 is a partly sectional front view to illustrate how the work table of the wood planing machine of FIG. 3 is adjusted to an upper position.

FIGS. 6 and 7 show how the work table 22 is adjusted from a lower position (see FIG. 6) to an upper position (see FIG. 7) by co-movement with the sliding member 40 and the threaded part 60 via rotation of the handle wheel 82, thereby changing the thickness of the wooden work-piece to be planed on the worktable 22.

Since the threaded part 60 is not directly and rigidly connected to the work table 22, the wearing and damage problem with respective to the threaded part as encountered in the prior art can be minimized.

With the invention thus explained, it is apparent that various modifications and variations can be made without departing from the spirit of the present invention. It is therefore intended that the invention be limited only as recited in the appended claims.

I claim:

1. A wood planing machine comprising:

a main support including a base that has opposite front and rear ends and opposite left and right ends, and front and rear side walls that respectively and uprightly project from said front and rear ends of said base, that cooperately confine a mounting space therebetween, and that define a top open end of said main support opposite to said base;

a mounting seat disposed in said mounting space and extending between and secured to said front and rear side walls, said mounting seat having an inclined mounting wall that extends inclinedly relative to a horizontal plane in a longitudinal direction from said right end of said base toward said left end of said base and that is formed with an elongated slot which extends in said longitudinal direction;

a sliding member that is slidably mounted on said inclined mounting wall within said mounting space, and that has a top wall extending in a horizontal direction parallel to said horizontal plane, said sliding member being slidable on said inclined mounting wall in said longitudinal direction;

a work table defining said horizontal plane, covering said top open end of said main support, and secured to said top wall of said sliding member so as to be co-slidable with said sliding member in said longitudinal direction; and a height adjusting unit including a screw unit, and a threaded part mounted securely on said sliding member via said screw unit which extends through said elongated slot, said sliding member and said threaded part so as to permit concurrent sliding movement of said sliding member and said threaded part on said inclined mounting wall in said longitudinal direction, said height adjusting unit further including a screw rod that is rotatably mounted on said mounting seat, that extends in said longitudinal direction, and that threadedly engages said threaded part so as to move said work table together with said sliding member and said threaded part in said longitudinal direction upon rotation.

2. The wood planing machine of claim 1, wherein said mounting seat includes a pair of front and rear mounting rails that respectively project from said front and rear side walls into said mounting space and that extend in said longitudinal direction, and a mounting plate that has front and rear ends respectively secured to said front and rear mounting rails, and that defines said inclined mounting wall, said elongated slot being formed in said mounting plate.

3. The wood planing machine of claim 2, wherein said sliding member includes a bottom plate extending in said longitudinal direction, slidably mounted on said mounting plate via said screw unit, and having front and rear ends, said sliding member further including front and rear plates of equal dimension that have top ends, and that respectively and uprightly project from said front and rear ends of said bottom plate in such a manner that said top ends of said front and rear plates extend in a direction parallel to said horizontal plane, said sliding member further including front and rear wings that respectively project from said top ends of said front and rear plates and that cooperately define said top wall of said sliding member.

4. The wood planing machine of claim 3, wherein said mounting plate is further formed with a guiding slot that extends in said longitudinal direction, said bottom plate of said sliding member being formed with an elongated aperture that is vertically aligned with said guiding slot, said sliding member further including a guide that is mounted securely on said bottomplate and that has a stud projecting downwardly therefrom through said elongated aperture and into said guiding slot for guiding movement of said sliding member on said mounting plate in said longitudinal direction.

* * * * *